US006446337B1

(12) United States Patent
Halm et al.

(10) Patent No.: US 6,446,337 B1
(45) Date of Patent: Sep. 10, 2002

(54) FORMATION OF TUBE SLOTS IN CLAD ALUMINUM MATERIALS

(75) Inventors: Immanuel Halm, Seven Hills; Richard A. Lempner, Strongsville, both of OH (US)

(73) Assignee: S & Z Tool & Die Co., Inc., Cleveland, OH (US)

( * ) Notice: Subject to any disclaimer, the term of this patent is extended or adjusted under 35 U.S.C. 154(b) by 0 days.

(21) Appl. No.: 09/724,034

(22) Filed: Nov. 28, 2000

(51) Int. Cl.[7] ..... B23P 15/26

(52) U.S. Cl. ..... 29/890.052; 29/890.08; 29/557; 29/527.2

(58) Field of Search ..... 72/334, 379.6, 72/333; 29/890.08, 890.052, 890.051, 557, 527.5, 527.6, 527.2, 527.3, 890.047; 228/183, 253, 254, 255

(56) References Cited

U.S. PATENT DOCUMENTS 2,909,281 A * 10/1959 Koskinen
2,994,123 A * 8/1961 Kritzer
3,245,465 A * 4/1966 Young
3,575,122 A * 4/1971 Brossart, Jr.
4,055,067 A * 10/1977 Kozima
4,118,968 A * 10/1978 Ames
4,146,164 A * 3/1979 Anderson et al.
4,150,556 A 4/1979 Melnyk
4,400,965 A * 8/1983 Schey
4,577,380 A 3/1986 Wamer
4,988,036 A * 1/1991 Kemble et al.
5,042,574 A * 8/1991 Cottone et al.
5,150,520 A 9/1992 DeRisi
5,180,098 A * 1/1993 Halstead et al.
5,228,512 A 7/1993 Bretl et al.
5,237,849 A * 8/1993 Miyazawa
5,761,949 A * 6/1998 Dalessandro et al.
5,797,291 A * 8/1998 Yamada

* cited by examiner

*Primary Examiner*—David P. Bryant
*Assistant Examiner*—T. Nguyen
(74) *Attorney, Agent, or Firm*—Rankin, Hill, Porter & Clark LLP

(57) ABSTRACT

A method of forming slots in a sheet of material having a cladding layer on at least one surface is disclosed. The method includes the step of pre-forming the material by forming depressions in the sheet. Each of the depressions has a bottom wall having the approximate dimensions of a desired slot. Each of the depressions also has sidewalls with the cladding thereon. The sidewalls extend from the bottom wall to the sheet which has not be pre-formed. The method also includes the step of removing the entire bottom wall of the depressions in a piercing operation, forming a slot in the sheet where the bottom wall was, and leaving the slot with substantially clad sidewalls.

10 Claims, 8 Drawing Sheets

FORMATION OF TUBE SLOTS IN CLAD ALUMINUM MATERIALS

BACKGROUND OF THE INVENTION

1. Field of the Invention

This invention relates to clad aluminum material, such as brazing alloy sheets of the type comprising a core of structural material and having on at least one side a cladding of a brazing alloy, and more particularly to a method by which slots are formed in sheets whereby the cladding remains on the sidewalls of the slot.

2. Description of the Prior Art

Brazing alloy sheets typically comprise an aluminum-based core with at least one side having a cladding of a cladding material. The cladding material is typically an aluminum-based brazing alloy containing silicon as the main alloying ingredient. The brazing alloy has a lower fusing point than the core material, and is used to facilitate brazing of a finished assembly made using the sheets. For example, the aluminum core may be 3000 series aluminum composition metal having a thickness of about 0.3 mm to 0.35 mm and a fusing point of about 350° C., while the brazing alloy may be a 4000 series aluminum composition metal having a fusing point of about 300° C.

Brazing sheets of this sort are commonly used in the manufacture of heat exchangers. In the typical construction of such heat exchangers, the heat exchanger has two generally parallel manifolds with a plurality of cooling tubes connected between them, and plurality of cooling fins attached to the tubes. The tubes are through the tubes to the other manifold. Heat exchangers of this type are used in automotive vehicles for several purposes, such as a radiator for cooling the engine and as charge air coolers.

The manifolds may be made of a molded plastic tank having an aluminum header plate or cover in which the plurality of spaced slots is formed for connection to the cooling tubes. Alternatively, each of the manifolds may be formed completely from aluminum and have a plurality of spaced slots along one side. The manifolds are also provided with connections for the introduction of the cooling medium. The header plates are usually made from a brazing sheet. The cooling tubes may also be made from abrazing sheet, or more commonly, are made from a nonclad aluminum sheet which is rolled into a tube and welded along the longitudinal seam. After assembly of the aluminum components of the heat exchanger, the assembly is brazed in an oven or furnace to hold the elements together as assembled and provide a sealed vessel for the cooling medium.

For purposes of making heat exchangers, the brazing sheets must exhibit a number of important properties, including corrosion resistance, formability, post-braze strength, and brazability. The brazabilty of the material is especially important since the finished heat exchangers rely upon the brazing operation in order to assure a fluid tight connection between the components, especially between the slots and the tubes. If a leak occurs, the cooling medium can quickly leak out of the heat exchanger creating a potentially dangerous condition.

The slots for the tubes have been commonly formed in the manifold or header plate in a piercing operation in which piercing members strike a blank formed from the brazing sheet and punch out the material to form the slots. The piercing operation removes the cladding material, along with the removed material, so that thereafter when a brazing operation is performed, the brazing material may not readily flow into the slot around the tube, and the connection can be inherently weak and may be one of the most likely portions of a heat exchanger to develop a leak.

The brazing of the completed assembly helps to prevent leaks, but the effectiveness of the brazing operation is dependent upon the cladding layer on the aluminum brazing sheet. When the slot is simply punched out, there is no cladding material on the side walls of the slot, and the brazing operation will not necessarily create a fluid tight connection between the slot and the tube. This is particularly likely where the tubes are formed from a nonclad aluminum sheet.

Various attempts have been made to improve the connection between the tubes and the headers. For example, in U.S. Pat. No. 4,577,380 issued to Warner, a coating of polytetrafluoroethylene (PFTE) is placed on the material sheet. A heated tool having a forward rounded nose is then used to make holes in the PTFE layer and push the material through the holes in the material sheet so that the PTFE lines the hole. This patent, however, does not recognize any need to deal with the brazing layer of a brazing sheet. Furthermore, the technique used for the PTFE layer would not be suitable for manipulating the brazing layer of a brazing sheet since the brazing layer is fixedly clad on the base layer of the sheet.

U.S. Pat. No. 4,150,556, issued to Melnyk, discloses a method for forming ferrules around the openings in the header used to mount the tubes. The method is a relatively complicated three step process which involves forming a pair of small holes at each end of the desired opening, and splitting the bottom wall of a depression along the length of the opening to form the ferrules. The method disclosed in this patent makes no effort to deal with clad surfaces, and there is nothing to indicate that the cladding would be present along the inside of the ferrules or would be present on the inside of slots if the ferrules were not formed by this method.

U.S. Pat. No. 5,228,512, issued to Bretl, discloses another method for forming slots in the header in which, first, initial apertures are first formed in the header which are smaller than the desired finished slots, and then the header is punched to enlarge the apertures into the desired slots and form flanges around the slot. This method relies upon the remaining material around the preliminary apertures to supply the material for the flanges. It has limitations regarding the thickness of the material that can be used, and due to the forming process it can result in fatigue problems and cracking at the ends of the slots.

SUMMARY OF THE INVENTION

The present invention provides an improved method for forming slots in clad aluminum materials, such as brazing sheets, in which the cladding is maintained on the side walls of the slot, so that when the brazing operation is performed, a fluid tight seal is formed between the slots and the tubes inserted therein, even if the tubes are made from nonclad material.

When the ends of the cooling tubes are assembled in the slots, the cladding on the side walls of each slot comes into contact with the cladding on the exterior of the tube. During the subsequent brazing operation, the brazing material layers on the tube exterior and the slot interior together facilitate the brazing of the tubes in the slots, increasing the likelihood of a fluid-tight connection between the tubes and the slots.

In accordance with the present invention, the slots are formed in a progressive die operation, which comprises a pre-extrusion station in which the brazing sheet is pre-formed or extruded into a plurality of depressions having dimensions greater than that of the desired slots, forming clad sidewalls, and a piercing station in which the entire bottom of the depression is removed and a slot is formed while the clad sidewalls are maintained. This two-step forming operation provides a method by which the brazing sheet is deformed in order to provide the cladding layer around the inside of the finished slots. With the presence of the cladding layer on the inside sidewalls of the slot, the effectiveness of the brazing operation is increased.

The method of the present invention has been found to be useful in forming slots in relative thick aluminum sheets. The method avoids the fatigue problems of the prior art, and reduces the cracking which may ordinarily appear at the ends of the slots.

The slot forming method of the present invention can be achieved with a minimal increase in expense. If a progressive die operation has been previously used to form the headers, the method of the present invention can be incorporated into the progressive die operation by adding two additional stations, replacing the single step piercing operation used to form the tube slots in the header with a two-step pre-extrusion and piercing operation. The resulting forming operation will provide slots on the brazing sheet with the cladding layer of brazing material present on the inside walls of the slot, so that the subsequent brazing operation used to fix the tubes in the slots will be stronger and more fluid tight.

These and other advantages are provided by the present invention of a method of forming slots in a sheet of material having a cladding layer on at least one surface, comprising the steps of pre-forming the material by forming depressions in the sheet, each of the depressions having a bottom wall having the approximate dimensions of a desired slot, each of the depressions also having sidewalls with the cladding thereon, the sidewalls extending from the bottom wall to the sheet which has not been pre-formed; and then removing the entire bottom wall of the depressions in a piercing operation, forming a slot in the sheet where the bottom wall was, and leaving the slot with substantially clad sidewalls.

DETAILED DESCRIPTION OF THE PREFERRED EMBODIMENT

Figure 1:
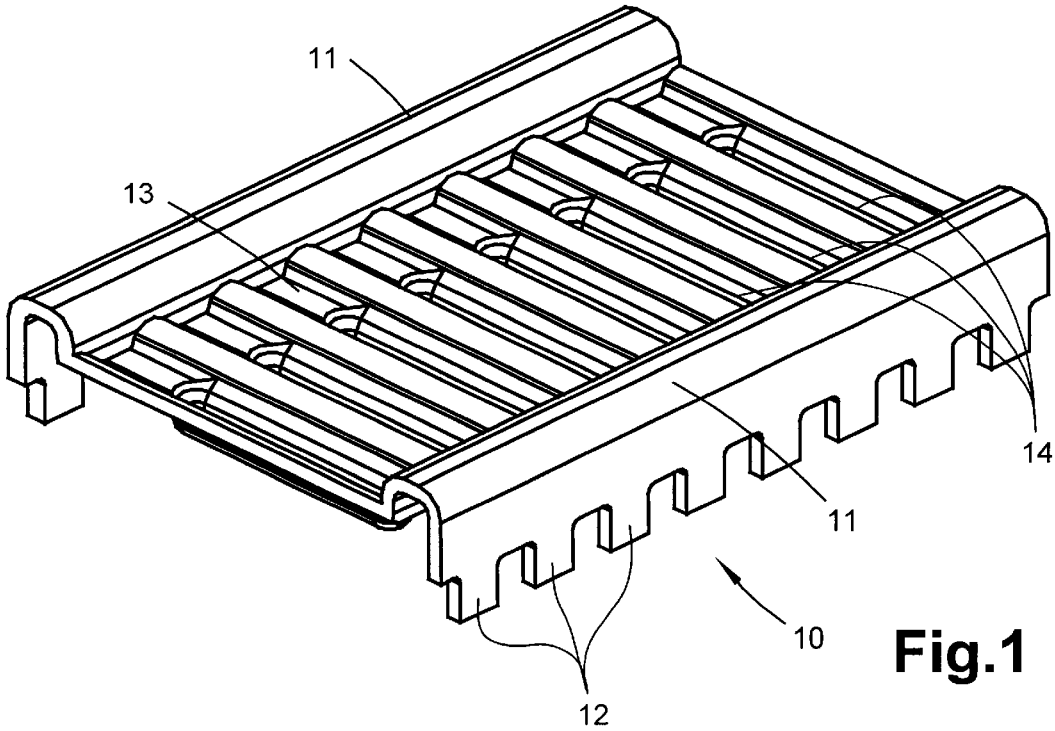
FIG. 1 is a perspective view of a header plate made according to the present invention.
Figure 2:
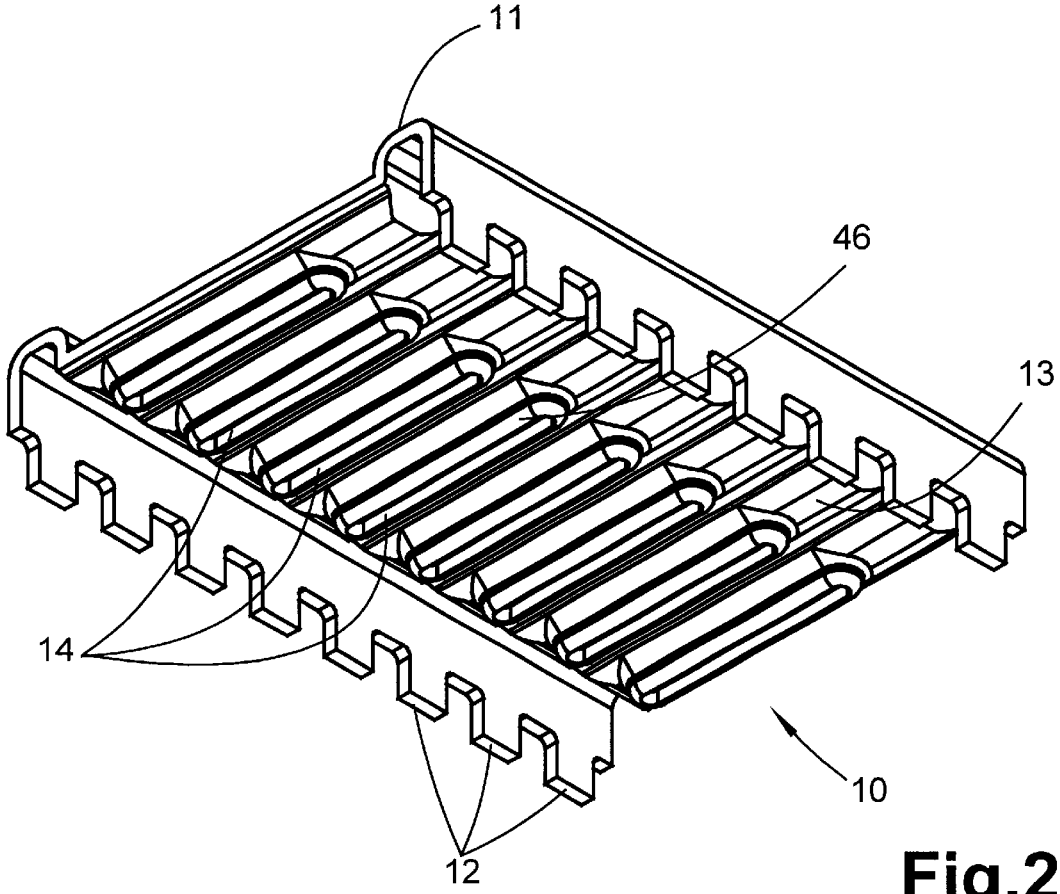
FIG. 2 is another perspective view of the header plate of FIG. 1 shown from underneath the eader plate.

Referring more particularly to the drawings and initially to FIGS. 1 and 2, there is shown a header plate 10 made according to the method of the present invention. The header 10 is used in a radiator or heat exchanger and is attached to a tank to form one side of the manifold to which a plurality of cooling tubes is attached. The header 10 includes a rim 11 having a plurality of tabs 12 which are deformed for attaching the header plate to the manifold tank. Within the rim is a generally planar header wall 13 in which a plurality of slots 14 is formed. The slots 14 are used for mounting a plurality of cooling tubes in the finished heat exchanger.

In accordance with the prior art, the tube slots in the header were traditionally formed by a simple piercing operation, either in a progressive die operation or in another comparable operation. While such a piercing operation provided satisfactory slots, the cladding material on the surface of the material was removed during the slot forming process, and, as a result, there was no cladding material on the sidewalls of the slot which did not assure a fluid tight connection after the final assembly is brazed, especially if the cooling tubes were not made of brazing sheet having cladding material.

The present invention provides an improved method for forming the tube slots 14 which provides for cladding material on the sidewalls of the slots and minimizes the possibility of leakage between the slots and the header. The method of the present invention is performed in a progressive die operation in which the header plate is formed.

Figure 3:
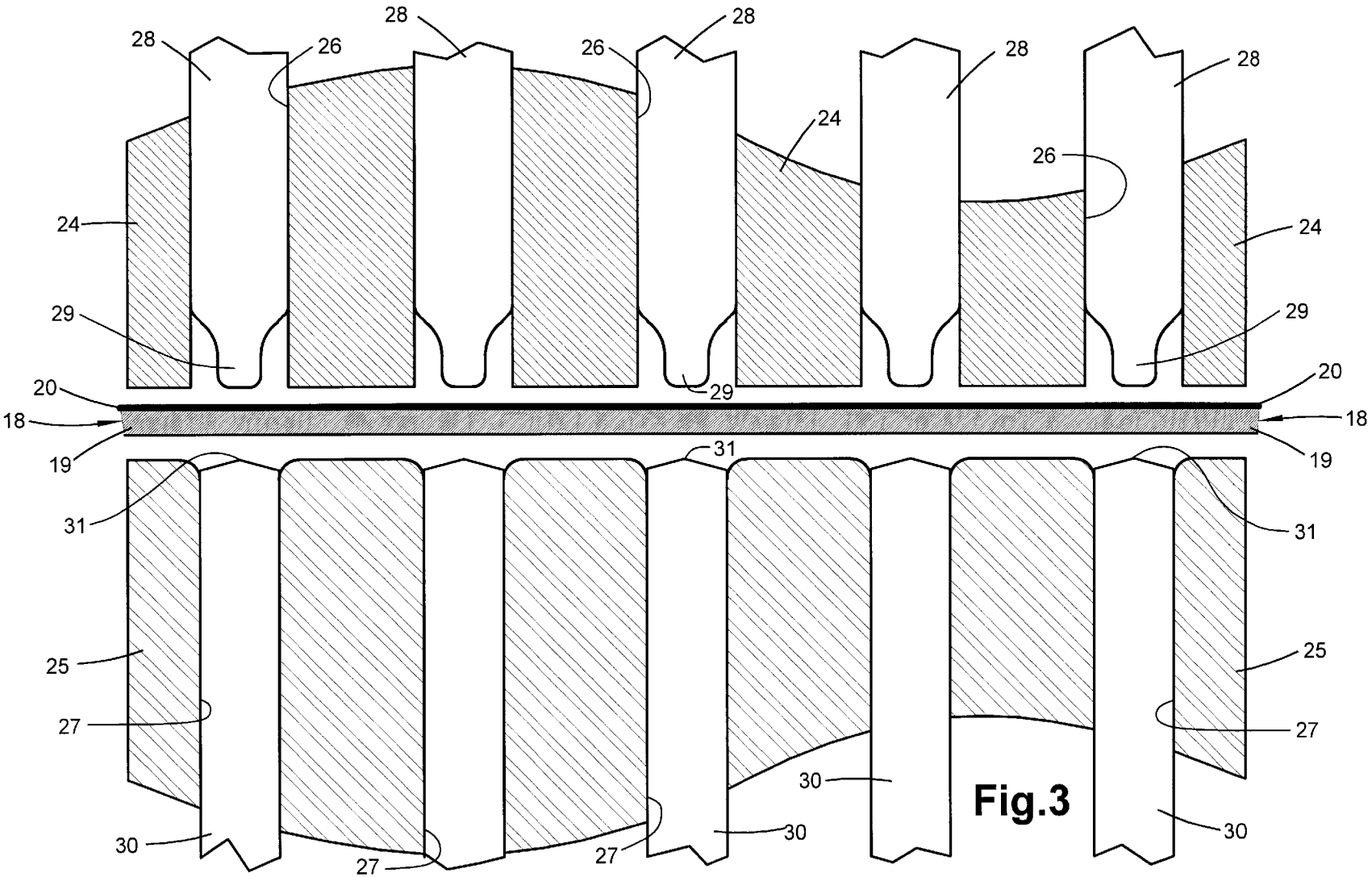
FIG. 3 is a sectional view of the pre-extrusion station of the die forming operation according the present invention, shown prior to the first forming operation.

The header 10 is made from a brazing sheet 18 of clad aluminum (FIG. 3). The brazing sheet 18 consists of a base layer 19 of a core material and an outer layer 20 on one side of cladding material. The cladding material may be a suitable aluminum-based brazing alloy containing an alloying ingredient. Such materials are well known in the fabrication of heat exchangers, and need not be discussed in further detail. The brazing sheet may be about 0.050 to 0.080 inches (1.3 to 2.0 mm) thick, with a cladding layer of about 5% to 12% of the brazing sheet thickness.

The brazing sheet 18 is fed into a series of stations in a progressive die forming operation. Many of the stations are used to form the rim and tabs of the header and other portions, and these stations need not be described here in detail as they form no part of this invention.

The pre-extrusion station is shown in FIG. 3. In this station, the brazing sheet 18 is feed into a die assembly and positioned between a stripper guide 24 and a die 25. The stripper guide 24 and the die 25 each have a plurality of elongated stripper openings 26 and 27 corresponding in location to the tube slots 14 to be formed in the sheet 18. The stripper openings 26 and 27 are, however, considerably wider than the desired width of the slots 14 in the finished part. For example, for slots 14 which are 0.071 inch (1.8 mm) in width, the stripper openings 26 in the stripper guide 24 could be 0.16 inch (4.1 mm). Each of the openings 27 in the die 25 has a rounded edge, and these openings 27 are generally narrower than the openings 26 in the stripper guide 24. For example, for the stripper guide having stripper openings 26 which are 0.16 inch (4.1 mm) wide, the openings 27 in the die 25 could be 0.13 inch (3.3 mm) wide.

Within the stripper openings 26 in the stripper guide 24 is a plurality of movable extruding members or forming punches 28, which are slidably mounted to move vertically within the stripper openings 26 in the pre-forming operation. Each of the forming punches 28 has a rounded, blunt, tapered, forward end. The forward end of each forming punch includes a portion 29 which is narrower in width than the remainder of the forming punch 28 and has a blunt forward end surface. The narrow portion 29 tapers outwardly to the width of the remainder of the forming punch.

Within the openings 27 in the die 25 is a plurality of corresponding movable coining inserts 30, which move vertically in opposition to the forming punches 28 to engage the brazing sheet 18 in the pre-forming operation. Each of the coining inserts 30 has a pointed end 31 forming a ridge running longitudinally along the insert. When the coining insert 30 moves vertically upwardly during the forming operation, the ridge 31 engages the sheet 18 and assists in stabilizing the sheet as it is simultaneously engaged by the forming punches 28.

Figure 4:
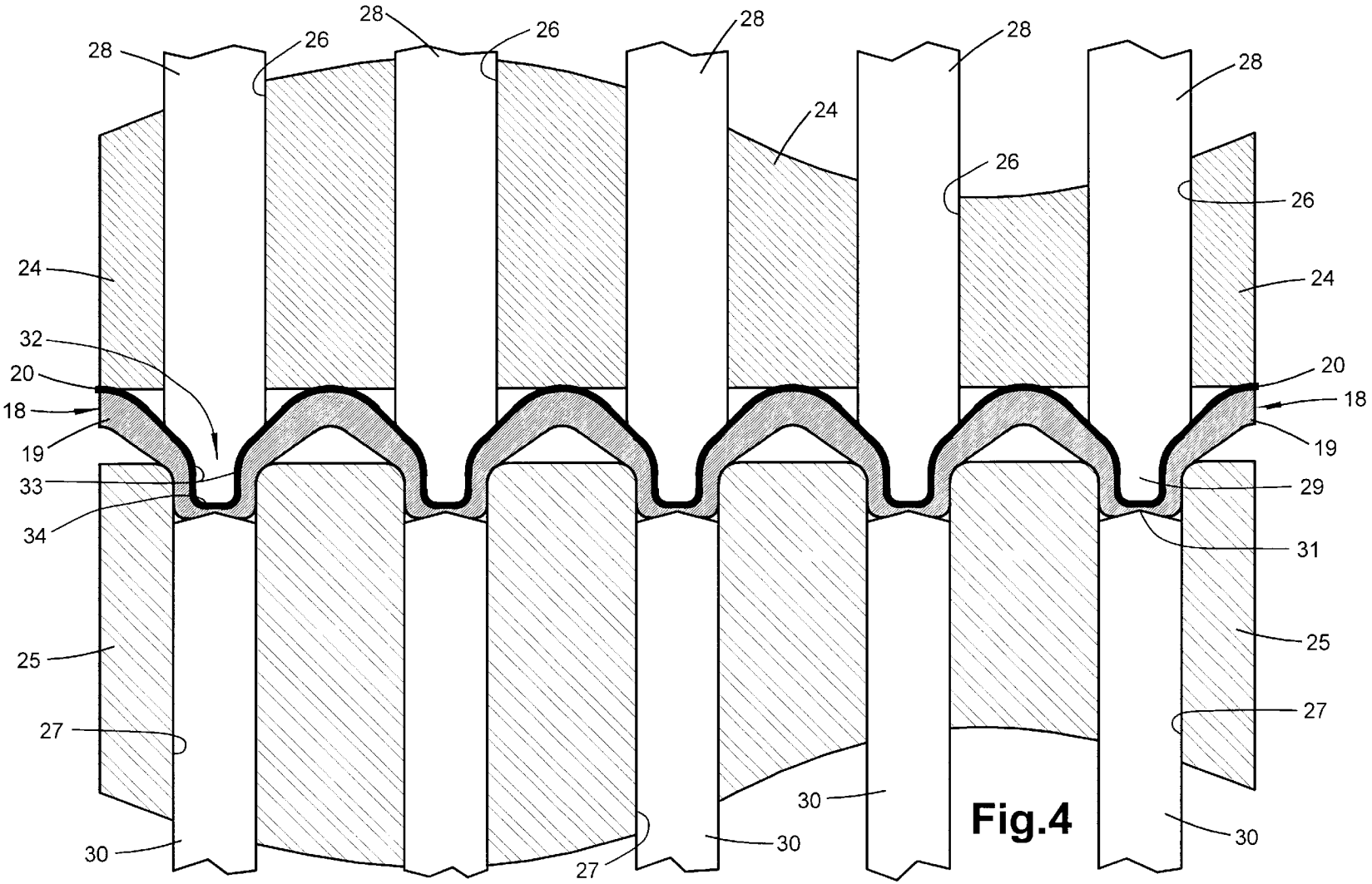
FIG. 4 is another side sectional view of the pre-extrusion station of FIG. 3, shown as the pre-extrusion operation is being completed.
Figure 5:
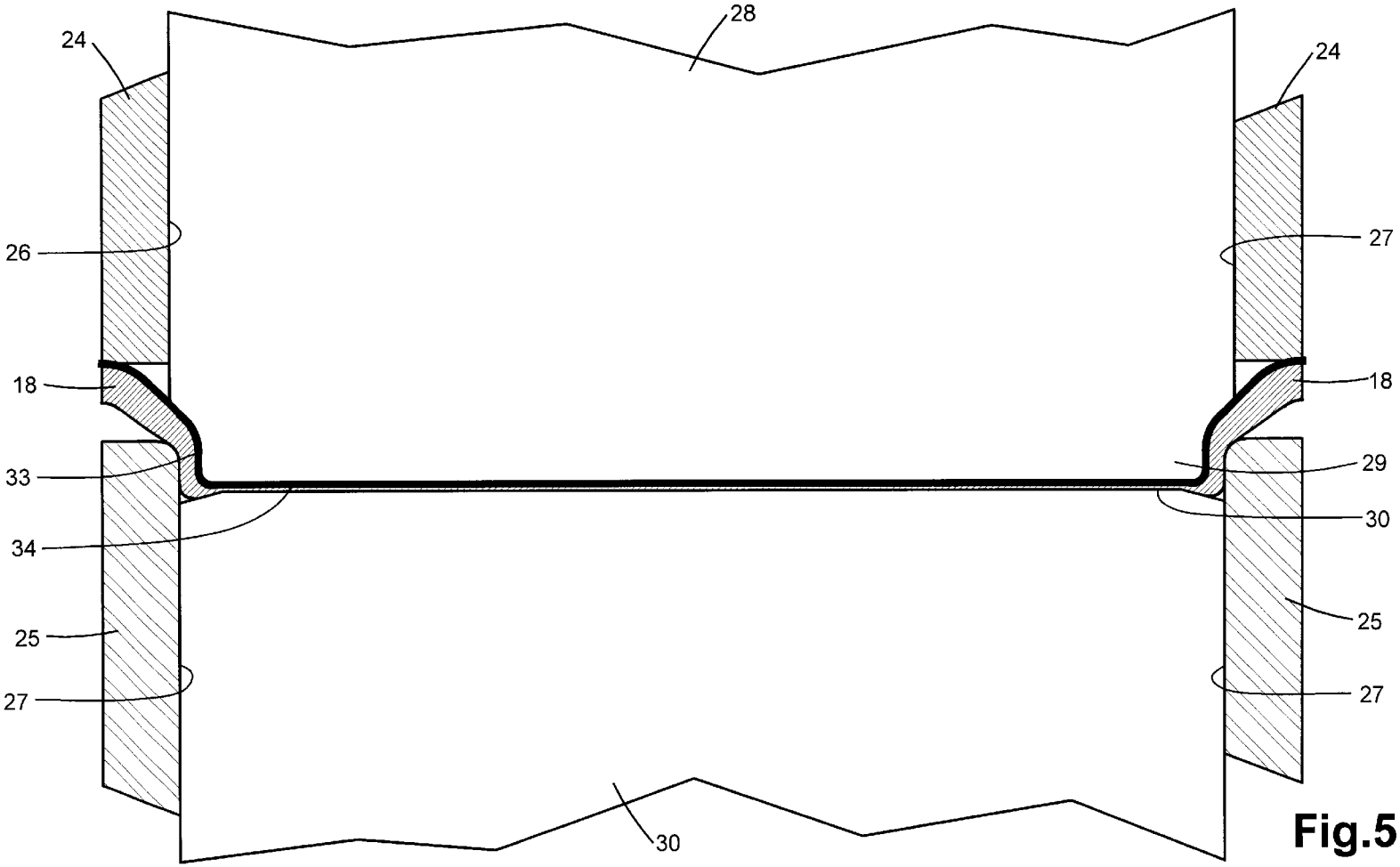
FIG. 5 is an end sectional view of the pre-extrusion station, shown at the same point in the pre-extrusion operation as that shown in FIG. 4.

As shown in FIGS. 4 and 5, the stripper guide 24, the die 25, the forming punches 28 and the coining inserts 30 operate together to form a plurality of depressions 32 in the brazing sheet 18. FIG. 4 shows a side view of these depressions, and FIG. 5 shows an end view. Each of these depressions has a sidewall 33 extending around all sides of the depression, and a bottom wall 34. The bottom wall 34 has the approximate dimensions of the desired finished slot. As the sheet 18 is fed between the stripper guide 24 and the die 25, the forming punches 28 and the coining inserts 30 move vertically toward each other to deform the sheet. The forming punches 28 move downwardly to form elongated clad depressions 32 in the sheet as the forward portions 29 push or extrude the brazing sheet material into the openings 27 in the die 25. Simultaneously, the coining inserts 30 retract within the openings 27 to provide the outer form for the depressions 32. Since each of the forward portions 29 is considerably narrower than the width of the corresponding opening 27, the depression is formed with a side wall 33 being formed between the forward portion 29 and the walls of the opening 27 in the die 25. Each depression 32 thus has a sidewall 33 with the cladding layer 20 preserved on the inside of the depression sidewall.

Figure 6:
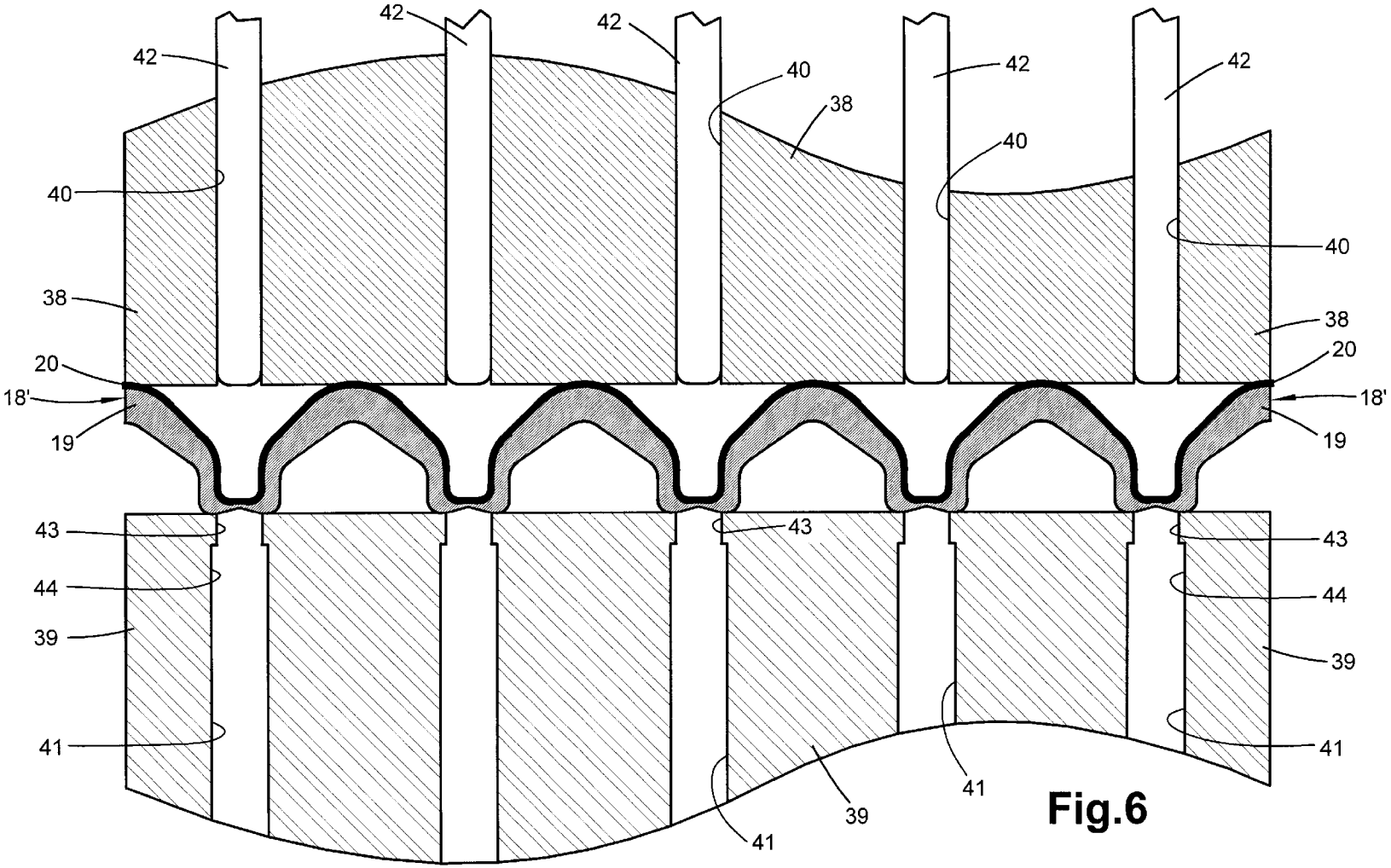
FIG. 6 is a side sectional view similar to FIGS. 3 and 4 of the next station in the forming operation, shown prior to the forming operation.
Figure 7:
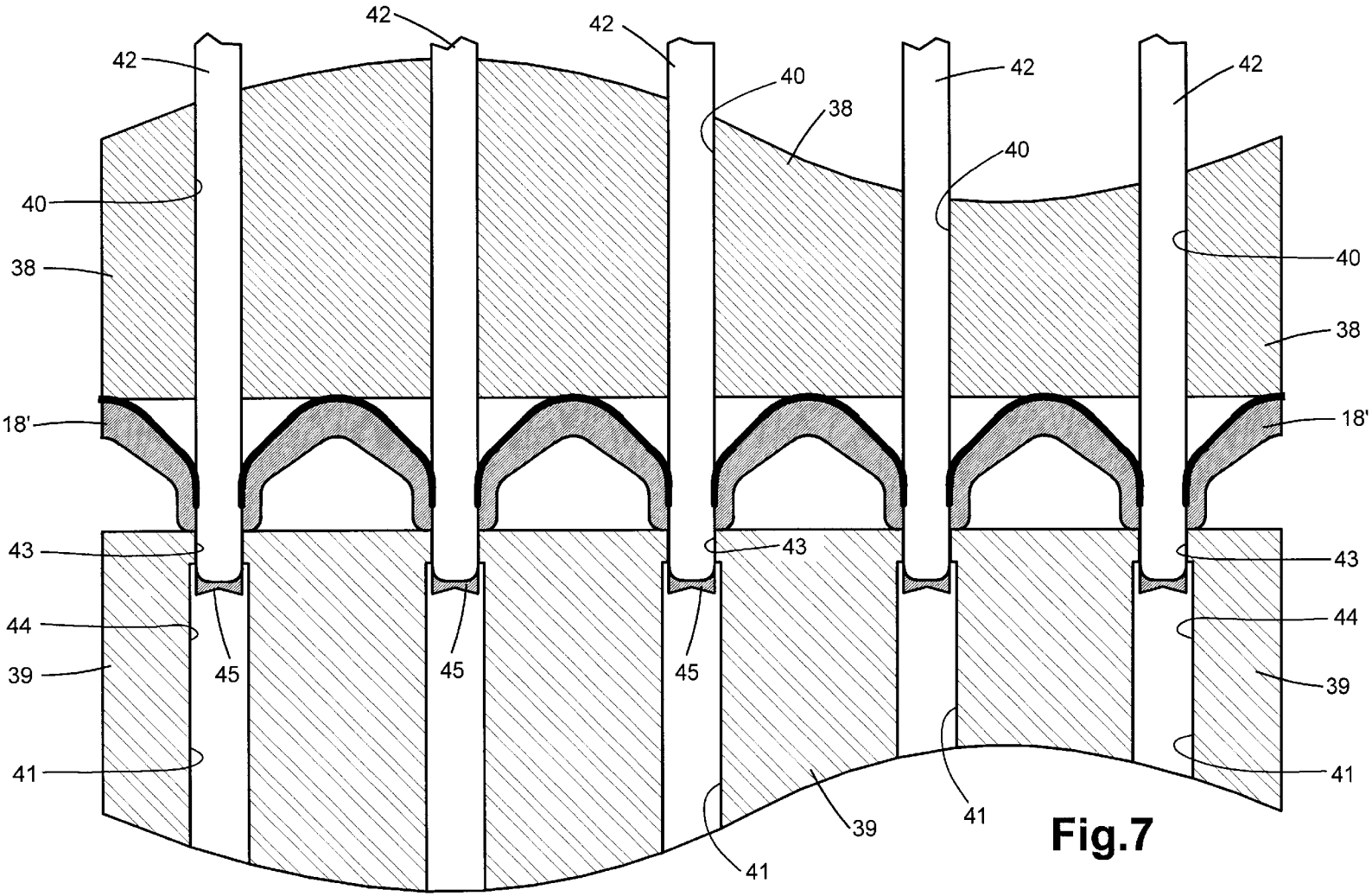
FIG. 7 is another side sectional view of the piercing station of FIG. 6 shown as the piercing operation is being completed.
Figure 8:
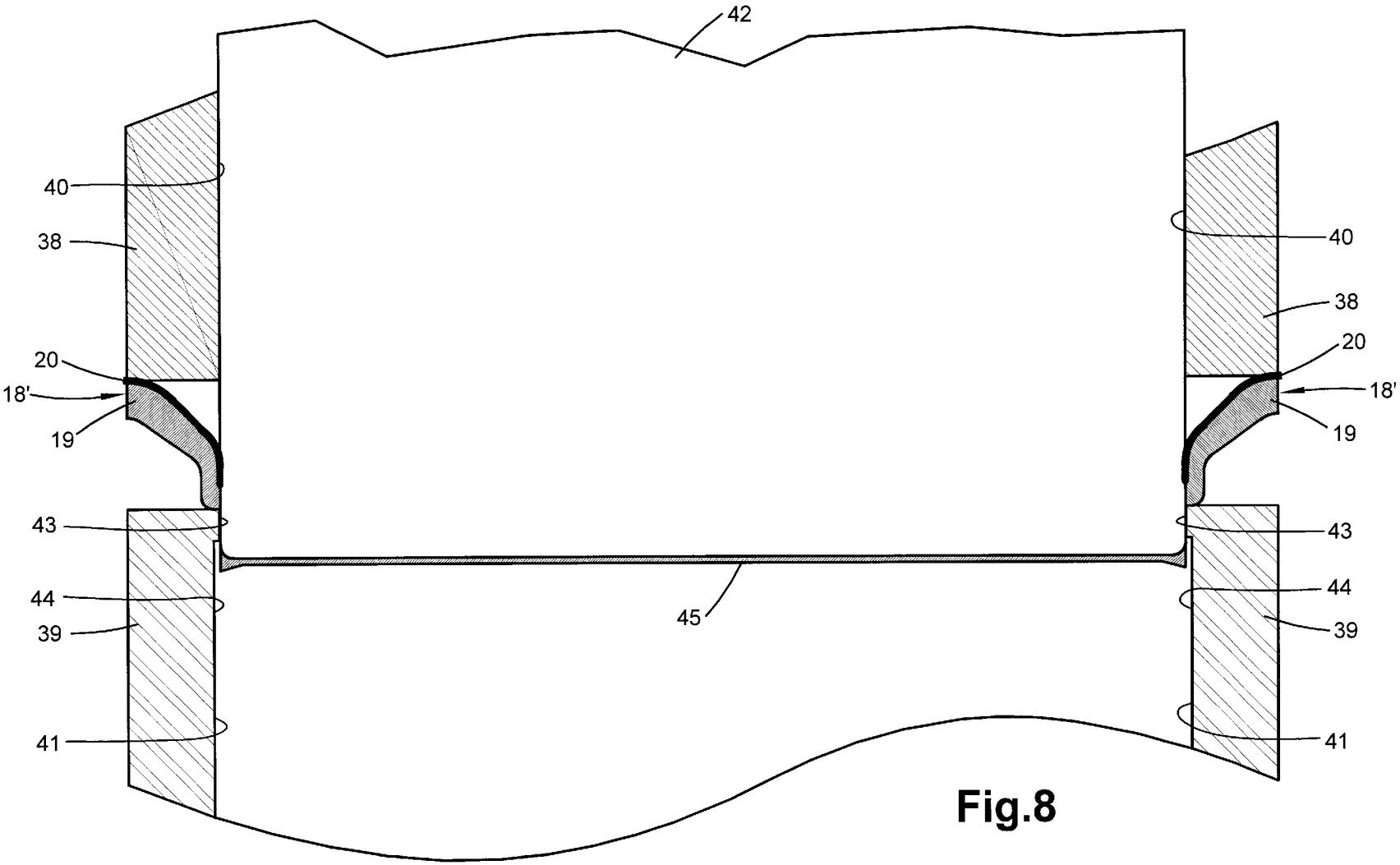
FIG. 8 is an end sectional view of the piercing station, shown at the same point in the piercing operation as that shown in FIG. 7.

Following the pre-extrusion station, the pre-formed sheet 18' moves to the piercing station shown in FIGS. 6–8. This station contains a die assembly comprising an stripper guide 38 and a die 39, each having openings 40 and 41 corresponding to the position of the elongated tube slots being formed. A plurality of piercing members or punches 42 is slidably mounted to move vertically within the stripper openings 40 in the stripper guide 38. Each of the piercing punches 42 has a width equal to the desired width of the finished tube slot. The lower openings 41 have a narrow piercing portion 43 which is slightly wider than the piercing punches. Below the piercing portion 43 is a wider clearance portion 44.

In the piercing operation, the pre-formed sheet 18' is fed from the pre-extrusion station to the piercing station and positioned between the stripper guide 38 and the die 39 such that the pre-formed depressions are adjacent to the lower openings 41. The piercing punches 42 then slide vertically downwardly within the openings 40 to engage the depressions and pierce through the bottom of the depressions, in engagement with the piercing portion 43 of the lower openings 41 to remove the material and form the slots. The removed material 45 is pushed by the piercing punches through the lower openings and into the clearance portion. As can be seen in FIGS. 7 and 8 the sidewalls of the resulting slot are not completely clad with the layer 20, since no cladding material is present where the bottom of the depressions have been removed. However, the sidewalls of the slot are substantially clad, so that the benefits of the present invention are realized.

The resulting header 10 can be seen with reference to FIGS. 1 and 2. As shown particularly in FIG. 2, each of the slots 14 is defined by a slight collar 46 extending uniformly around the slot from the header wall 13. The collar is formed on the bottom side of the header plate 10 and thus does not interfere with the positioning of the cooling tubes. The collars 46 are a result of each of the slots 14 having a formed sidewall with the cladding layer present in each of the sidewalls.

In the manufacture of heat exchangers using the method oft his invention, the header is formed in a progressive die forming operation or other operation with the pre-extrusion and piercing steps described above forming a part of this operation. The other components of the heat exchanger are formed by conventional methods, and the heat exchanger is assembled from the headers, and the other components, including the tank, tubes and fins. The ends of the tubes are inserted into the slots in the header which have been formed by the pre-extrusion and piercing steps described above. The tubes are also made, usually from a sheet of nonclad aluminum material, and the resulting assembly has the tubes inserted into the slots with the inside walls of the slots retaining the clad layer. The assembly is brazed in an oven or furnace to strengthen the resulting assembly and provide a fluid tight vessel for the cooling medium. The fluid tight connection between the header and the tubes is provided by brazing these two components together, and the efficiency of the brazing operation is facilitated by the brazing layers which are clad on the material used to make the components. Since the slots in the header have the brazing layer on the inside, the opportunity for achieving a fluid tight connection between the tubes and the header is increased in the brazing operation.

While the invention has been described with reference to a progressive die forming operation, it should be understood that other forming operations known in the art can be used to make the header in accordance with the present invention. For example, transfer tooling or hand-fed line tooling can be used. The present inveniton is not limited in its applicability to progressive die operations.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A method of forming slots in a sheet of material having a cladding layer on at least one surface, comprising the steps of:

pre-forming the material by forming depressions in the sheet, each of the depressions having a bottom wall having the approximate dimensions of a desired slot, each of the depressions also having sidewalls with the cladding thereon, the sidewalls extending from the bottom wall to the sheet which has not been pre-formed, each of the depressions also having end walls with the cladding thereon, the end walls extending from the bottom wall to the sheet which has not been pre-formed, the end walls extending between the side walls; and removing the entire bottom wall of the depressions in a piercing operation without deforming the sidewalls, forming a slot in the sheet where the bottom wall was, and leaving the slot with clad sidewalls and clad end walls.

2. A method of claim 1, wherein the pre-forming step and the removing step are performed in a progressive die forming operation.

3. A method of claim 2, wherein the pre-forming step is performed using a forming die assembly having a plurality of extruding members which are slidably mounted with a stripper guide.

4. A method of claim 3, wherein the pre-forming step uses extruding members which are larger in cross-sectional dimension than the slots to be formed.

5. A method of claim 3, wherein the pre-forming step uses extruding members each of which has a blunt forward end.

6. A method of claim 5, wherein the pre-forming step uses extruding members having blunt forward ends which have the same general dimension of the slots to be formed.

7. A method of claim 2, wherein the removing step is performed using a forming die assembly having a plurality of piercing members which are slidably mounted with a stripper guide.

8. A method of claim 7, wherein the removing step uses piercing members which have the same general dimension of the slots to be formed.

9. A method of claim 1, wherein the sidewalls form a collar extending uniformly around the slot.

10. A method of forming slots in a sheet of material having a cladding layer on at least one surface, comprising the steps of:

positioning the sheet in a first forming die, the sheet being generally flat in a plane;

pre-forming the material by engaging the sheet with the first forming die to form depressions in the sheet, each of the depressions having a bottom wall having the approximate dimensions of a desired slot, each of the depressions also having sidewalls and end walls with the cladding thereon, the sidewalls extending generally perpendicularly to the plane of the sheet from the bottom wall to the plane of the sheet, the end walls extending generally perpendicularly to the plane of the sheet from the bottom wall to the sheet, the end walls extending between the side walls;

moving the sheet following the pre-forming step and positioning the sheet in a second forming die;

piercing the depressions with the second forming die to remove the entire bottom wall of the depressions without deforming the sidewalls; and removing the sheet following the piercing step to provide a slot in the sheet where the bottom wall was, and leaving the slot with clad sidewalls and clad end walls.

* * * * *